US007699306B2

(12) United States Patent
Lim et al.

(10) Patent No.: US 7,699,306 B2
(45) Date of Patent: Apr. 20, 2010

(54) PAPER PICKING-UP UNIT AND IMAGE FORMING APPARATUS HAVING THE SAME

(75) Inventors: Kwang-taek Lim, Kwangmyung-si (KR); Byung-sun Ahn, Suwon-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 1207 days.

(21) Appl. No.: 11/146,066

(22) Filed: Jun. 7, 2005

(65) Prior Publication Data

US 2006/0033258 A1 Feb. 16, 2006

(30) Foreign Application Priority Data

Aug. 9, 2004 (KR) ..... 10-2004-0062514

(51) Int. Cl.
*B65H 1/08* (2006.01)

(52) U.S. Cl. ..... 271/127; 271/119

(58) Field of Classification Search ..... 271/109, 271/126, 127, 119, 120, 121, 117, 118; 492/47, 492/6, 21; 198/781.04; 347/104; 400/629
See application file for complete search history.

(56) References Cited

U.S. PATENT DOCUMENTS

| | | | | |
|---|---|---|---|---|
| 4,799,662 | A * | 1/1989 | Sagara et al. | 271/114 |
| 5,326,184 | A * | 7/1994 | Shibata | 400/624 |
| 5,775,688 | A | 7/1998 | Kato et al. | |
| 5,918,873 | A | 7/1999 | Saito et al. | |
| 6,070,867 | A * | 6/2000 | Tsurumi et al. | 271/114 |
| 6,139,006 | A * | 10/2000 | Asada | 271/121 |
| 6,293,539 | B1 | 9/2001 | Fukatsu et al. | |
| 6,305,682 | B1 | 10/2001 | Saito et al. | |
| 6,932,529 | B2 * | 8/2005 | Richtsmeier et al. | 400/624 |
| 7,222,570 | B2 * | 5/2007 | Kawamura et al. | 101/477 |
| 2004/0178558 | A1 * | 9/2004 | Graef et al. | 271/109 |
| 2006/0017213 | A1 * | 1/2006 | Maeda et al. | 271/10.01 |
| 2007/0001376 | A1 * | 1/2007 | Lim et al. | 271/121 |

FOREIGN PATENT DOCUMENTS

| | | |
|---|---|---|
| JP | 04-36124 | 12/1992 |

(Continued)

*Primary Examiner*—Patrick H Mackey
*Assistant Examiner*—Jeremy Severson
(74) *Attorney, Agent, or Firm*—Stanzione & Kim, LLP

(57) ABSTRACT

A paper picking-up unit and an image forming apparatus having the same are provided. The paper picking-up unit includes a knock-up plate to stack paper thereon; a shaft disposed at a front end of the knock-up plate to rotate, a pick-up roller engaged with the shaft to rotate and pick-up the paper stacked on the knock-up plate, and a knock-up plate ascending and descending portion to raise and lower the knock-up plate according to the rotation of the pick-up roller. The pick-up roller includes a roller body engaged and rotatable with the shaft, and having a frictional layer to pick-up the paper by causing friction with the paper, a pair of roller housings to support opposite sides of the roller body such that the roller body does not move in a lengthwise direction of the shaft, and a damper disposed at an outer circumference of each roller housing to reduce noise caused by a collision of the roller housings and the knock-up plate.

12 Claims, 6 Drawing Sheets

FOREIGN PATENT DOCUMENTS

| | | |
|---|---|---|
| JP | 07-2375 | 1/1995 |
| JP | 08-67367 | 3/1996 |
| JP | 08-198465 | 8/1996 |
| JP | 09-315611 | 12/1997 |
| JP | 10-250857 | 9/1998 |
| JP | 11-301872 | 11/1999 |

* cited by examiner

PAPER PICKING-UP UNIT AND IMAGE FORMING APPARATUS HAVING THE SAME

CROSS-REFERENCE TO RELATED APPLICATIONS

This application claims the priority under 35 U.S.C. § 119 of Korean Patent Application No. 2004-62514, filed on Aug. 9, 2004, in the Korean Intellectual Property Office, the disclosure of which is incorporated herein in its entirety by reference.

BACKGROUND OF THE INVENTION

1. Field of the Invention

The present general inventive concept relates to a paper picking-up unit and an image forming apparatus having the same, and more particularly, to a paper picking-up unit having an improved structure in which noise occurring during a paper picking-up operation is reduced, and an image forming apparatus having the same.

2. Description of the Related Art

In general, an image forming apparatus, such as a printer or copier, includes a paper picking-up unit which receives a plurality of papers, picks up each of the plurality of received papers and supplies the picked-up paper into a main body of the image forming apparatus. FIGS. 1 and 2 are perspective views of an example of a conventional paper picking-up unit. FIG. 1 shows a state just before a paper is picked up, and FIG. 2 shows the instant the paper is picked up.

Referring to FIGS. 1 and 2, a conventional paper picking-up unit 10 comprises a knock-up plate 12, which is coupled with a hinge 14 to a paper feeding cassette (not shown) mounted in a main body (not shown) of an image forming apparatus, and on which a paper P is stacked, a spring 18 which elastically biases the knock-up plate 12 in an upward direction, and a pick-up roller 20, which is disposed in the main body (not shown) of the image forming apparatus and positioned on the knock-up plate 12.

The pick-up roller 20 comprises a roller body 21, which is engaged with a shaft 28 for transferring a rotative power when rotated, has a generally semicircular shape and includes a frictional layer generally formed of rubber and disposed on an outer circumference of the roller body 21 so as to pick up the paper P, and a roller housing 25 which supports both sides of the roller body 21 so that the roller body 21 does not move in a lengthwise direction of the shaft 28.

A pair of cams 30 are engaged with both sides of the shaft 28 in the state where the pick-up roller 20 is placed between the pair of cams 30. The cams 30 press both sides of the knock-up plate 12 in a printing standby state and separate a front end of the paper P from the pick-up roller 20.

If a printing instruction is input into an image forming apparatus (not shown), the pick-up roller 20 and the cam 30 rotate in the direction of arrows shown in FIGS. 1 and 2 by rotation of the shaft 28, and as shown in FIG. 2, the knock-up plate 12 pressed by the cam 30 in a downward direction rotates around the hinge 14 by elasticity of the spring 18 when the cam 30 is removed, and the front end of the knock-up plate 12 apart from the hinge 14 rises. As such, the front end of the paper P stacked on the knock-up plate 12 contacts the roller body 21 of the rotating pick-up roller 20, is picked up by friction with the frictional layer disposed on the outer circumference of the roller body 21, and is fed into the main body (not shown) of the image forming apparatus.

However, the knock-up plate 12 collides with an outer circumference of the roller housing 25 when the knock-up plate 12 rises, resulting in noise. This noise continues until a printing operation is terminated when several papers are printed continuously, and is disturbing to a user.

In particular, if a small number of the papers P are stacked on the knock-up plate 12, shocks that occur when the knock-up plate 12 collides with the roller housing 25 are not reduced, and noise becomes more severe. In addition, due to the shocks, the paper P may be deviated from its registered position, and jam or skew of the paper P may occur.

SUMMARY OF THE INVENTION

The present general inventive concept provides a paper picking-up unit having a portion to reduce collision noise and shocks when a pick-up roller and a knock-up plate collide with each other when the knock-up plate rises, and an image forming apparatus having the same.

Additional aspects and advantages of the present general inventive concept will be set forth in part in the description which follows and, in part, will be obvious from the description, or may be learned by practice of the general inventive concept.

The foregoing and/or other aspects and advantages of the present general inventive concept are achieved by providing a paper picking-up unit, the paper picking-up unit including a knock-up plate to stack paper thereon, a shaft disposed at a front end of the knock-up plate to rotate, a pick-up roller engaged with the shaft to rotate and pick up the paper stacked on the knock-up plate, and a knock-up plate ascending and descending portion to raise and lower the knock-up plate according to the rotation of the pick-up roller, wherein the pick-up roller includes a roller body engaged with the shaft to rotate, and having a frictional layer to pick up the paper by causing friction with the paper, a pair of roller housings to support opposite sides of the roller body such that the roller body does not move in a lengthwise direction of the shaft, and a damper disposed at an outer circumference of each roller housing to reduce noise caused by a collision of the roller housings and the knock-up plate.

The damper may be a shock-absorbing piece extending from a first portion of the outer circumference to a second portion of the outer circumference of the respective roller housing.

A first end of the shock-absorbing piece may be formed with the first portion of the outer circumference of the respective roller housing as a single body, and a second end thereof may be separated from the second portion of the outer circumference of the respective roller housing.

The first end and the second end of the shock-absorbing piece may be respectively formed with the first portion of the outer circumference and the second portion of the outer circumference of the respective roller housing as a single body.

The shock-absorbing piece may be separately formed from the respective roller housing, and the first end and the second end of the shock-absorbing piece may be respectively combined with the first portion of the outer circumference and the second portion of the outer circumference of the respective roller housing.

A frictional coefficient of the damper may be less than a frictional coefficient of the frictional layer of the roller body.

The foregoing and/or other aspects and advantages of the present general inventive concept are also achieved by providing an image forming apparatus including a printing unit to print an image on paper and a paper picking-up unit to transfer the paper into the printing unit, wherein the paper picking-up unit includes a knock-up plate to stack the paper thereon, a shaft disposed at a front end of the knock-up plate to rotate, a pick-up roller engaged with the shaft to rotate and pick up the paper stacked on the knock-up plate, and a knock-up plate ascending and descending portion to raise and lower the knock-up plate according to the rotation of the pick-up roller, wherein the pick-up roller includes a roller body engaged with the shaft to rotate, and having a frictional layer to pick up the paper by causing friction with the paper, a pair of roller housings to support opposite sides of the roller body such that the roller body does not move in a lengthwise direction of the shaft, and a damper disposed at an outer circumference of each roller housing to reduce noise caused by a collision of the roller housings and the knock-up plate.

The damper may be a shock-absorbing piece extending from a first portion of the outer circumference to a second portion of the outer circumference of the respective roller housing.

A first end of the shock-absorbing piece may be formed with the first portion of the outer circumference of the respective roller housing as a single body, and a second end thereof may be separated from the second portion of the outer circumference of the respective roller housing.

The first end and the second end of the shock-absorbing piece may be respectively formed with the first portion of the outer circumference and the second portion of the outer circumference of the respective roller housing as a single body.

The shock-absorbing piece may be separately formed from the roller housings, and the first end and the second end of the shock-absorbing piece may be respectively combined with the first portion of the outer circumference and the second portion of the outer circumference of the respective roller housing.

A frictional coefficient of the damper may be less than a frictional coefficient of the frictional layer of the roller body.

BRIEF DESCRIPTION OF THE DRAWINGS

These and/or other aspects and advantages of the present general inventive concept will become apparent and more readily appreciated from the following description of the embodiments, taken in conjunction with the accompanying drawings of which.

DETAILED DESCRIPTION OF THE PREFERRED EMBODIMENTS

Figure 1:
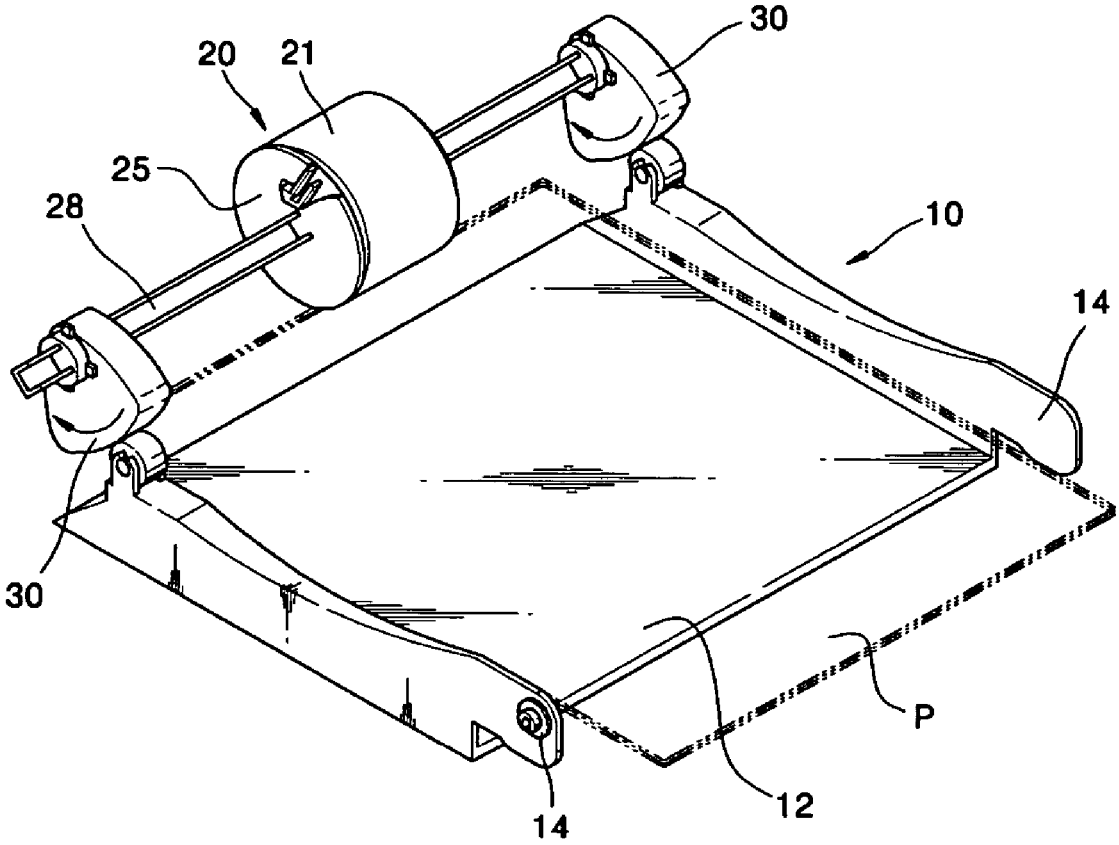
FIG. 1 (PRIOR ART)
FIG. 1 is a perspective view of a conventional paper picking-up unit in a state just before a paper is picked up.
Figure 2:
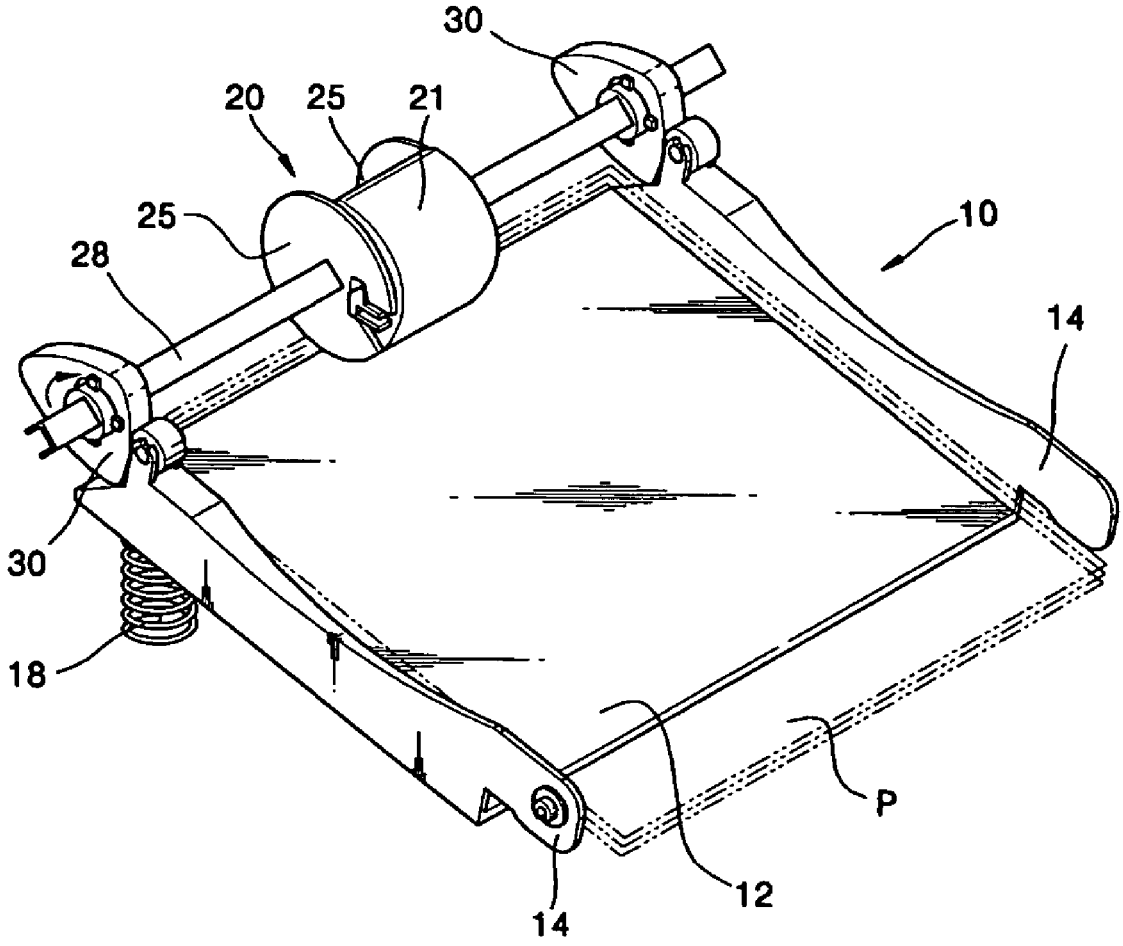
FIG. 2 (PRIOR ART)
FIG. 2 is a perspective view of the conventional paper picking-up unit of FIG. 1 at the instant the paper is picked up.

Reference will now be made in detail to the embodiments of the present general inventive concept, examples of which are illustrated in the accompanying drawings, wherein like reference numerals refer to the like elements throughout. The embodiments are described below in order to explain the present general inventive concept while referring to the figures.

Figure 3:
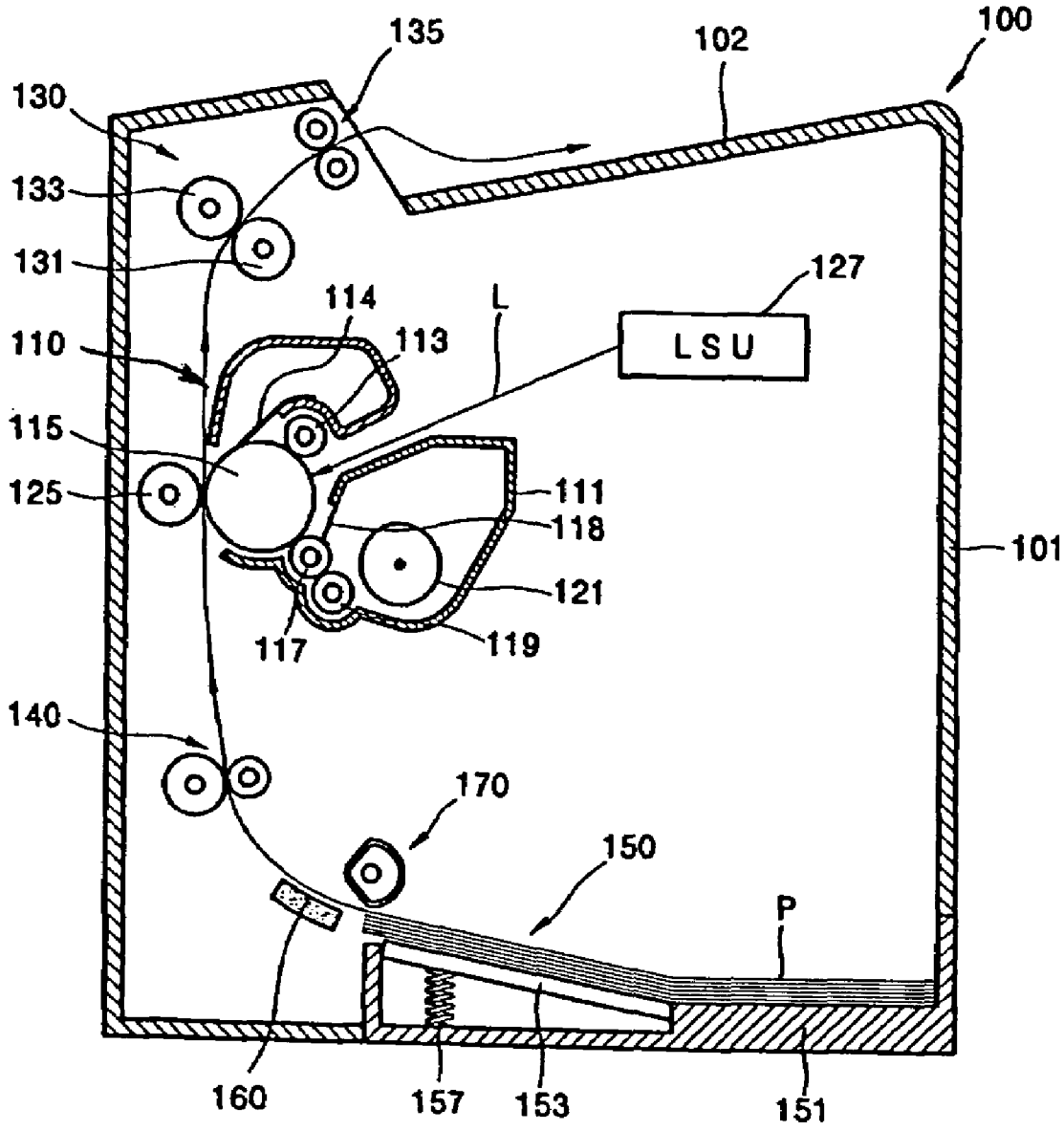
FIG. 3 is a cross-sectional view illustrating an image forming apparatus according to an embodiment of the present general inventive concept.

FIG. 3 is a cross-sectional view illustrating an image forming apparatus 100 according to an embodiment of the present general inventive concept.

Referring to FIG. 3, the image forming apparatus 100 is a so-called 'electrophotolithographic image forming apparatus' which supplies toner as a developing agent to an electrostatic latent image formed on an outer surface of a photosensitive medium by light radiation to develop the electrostatic latent image as a visible image, transfers the developed image onto paper P and fuses the image on the paper P, thereby printing a desired image. In the image forming apparatus 100, the paper P travels along a transfer path having an approximate C-shape as the paper P moves through the image forming apparatus 100. The image forming apparatus 100 includes a case 101, and a developing unit 110, a fusing unit 130, a transfer roller 125, and a light scanning unit (LSU) 127, which are printing units mounted in the case 101. The image forming apparatus 100 further includes a paper picking-up unit 150 which picks up the paper P to be printed.

The developing unit 110 includes a housing 111 in which the toner as the developing agent is stored, a photosensitive medium 115 which forms an electrostatic latent image by light radiation inside the housing 111, a charging roller 113 which charges the photosensitive medium 115, a waste toner cleaner 114 which removes a waste toner remaining in the photosensitive medium 115, a developing roller 117 which develops a visible image on an outer surface of the photosensitive medium 115 by supplying the toner to the electrostatic latent image formed on the outer surface of the photosensitive medium 115, a doctor blade 118 which regulates a thickness of the toner attached to the surface of the developing roller 117, and a supplying roller 119 which supplies the toner to the developing roller 117. In addition, an agitator 121, which agitates the toner to prevent the toner from becoming hard, is disposed in the housing 111. The developing unit 110 has a cartridge shape, and the developing agent in the developing unit 10 can be replaced when it is consumed.

The transfer roller 125 is installed to face and contact the photosensitive medium 115 and presses the paper P toward the photosensitive medium 115 such that the visible image developed on the outer surface of the photosensitive medium 115 is transferred onto the paper P, which passes between the transfer roller 125 and the photosensitive medium 115.

The fusing unit 130 includes a heating roller 131 and a pressing roller 133 opposite to the heating roller 131. When the paper P onto which the visible image is transferred passes between the heating roller 131 and the pressing roller 133, the visible image is fused on the paper P by a thermal press using heat and pressure.

In addition, the image forming apparatus 100 includes a paper aligning unit 140 which supplies a transfer force to the paper P picked up by the paper picking-up unit 150 and aligns the paper P such that the visible image can be transferred onto a desired portion of the paper P when the paper P reaches the photosensitive medium 115. The image forming apparatus 100 further includes a paper discharging roller 135 which discharges the paper P on which the visible image is fused by the fusing unit 131 to a paper discharging stand 102 at an outer portion of the case 101.

Operations of the image forming apparatus having the above structure will now be described. The photosensitive medium 115 is charged by the charging roller 113 to a predetermined potential, and an electrostatic latent image corresponding to an image to be printed is formed on the outer surface of the photosensitive medium 115 according to a light beam L scanned by the LSU 127. The toner inside the housing 111 is supplied by the supplying roller 119 and the developing roller 117 to the photosensitive medium 115 on which the electrostatic latent image is formed, and the visible image is developed on the outer surface of the photosensitive medium 115. The paper P is picked up by the paper picking-up unit 150, fed and aligned by the paper aligning unit 140 and passes between the photosensitive medium 115 and the transfer roller 125. In this case, the visible image developed on the outer surface of the photosensitive medium 115 is transferred on a side of the paper P facing the photosensitive medium 115. The image transferred onto the paper P is fused on the paper P by heat and pressure when the paper P passes through the fusing unit 130. The paper P is then transferred by the paper discharging roller 135 and stacked on the paper discharging stand 102.

Figure 4:
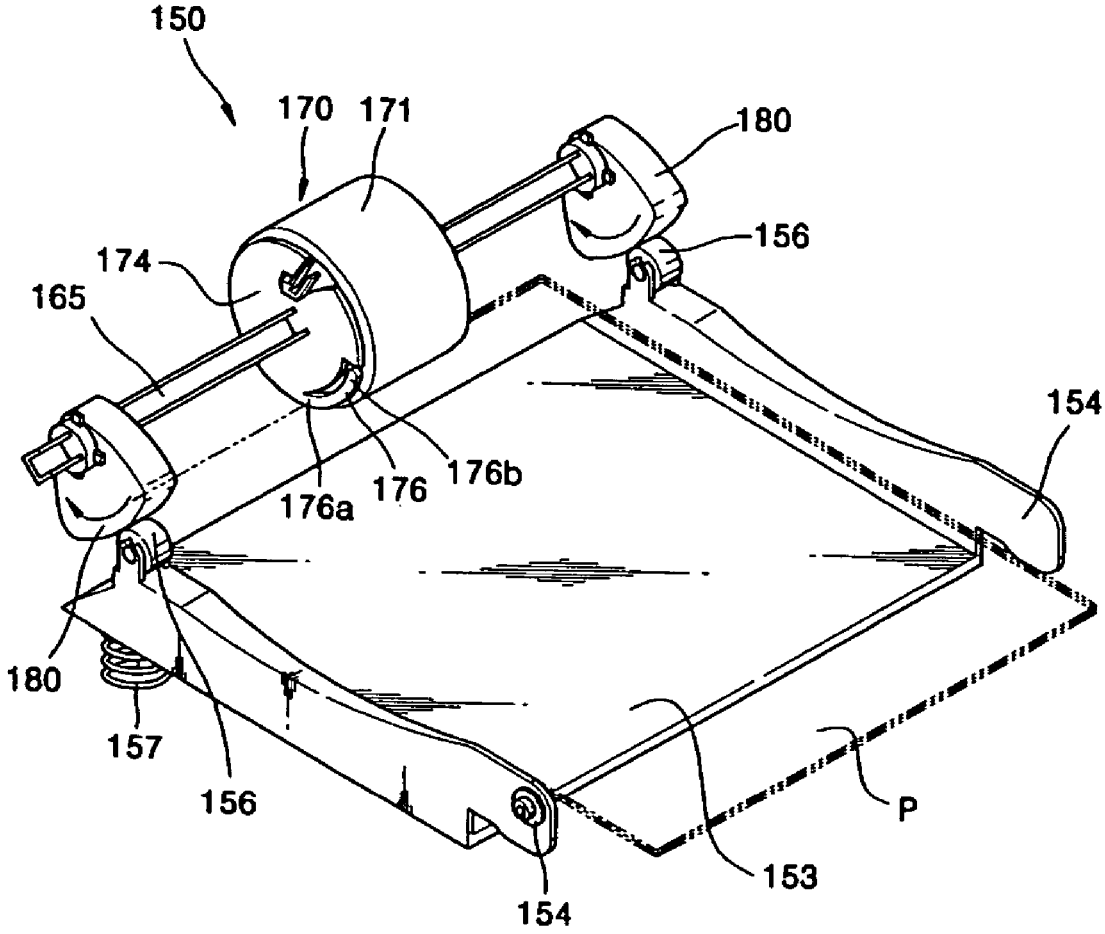
FIG. 4 is a perspective view illustrating a paper picking-up unit of the image forming apparatus of FIG. 3 in a state just before a paper is picked up.
Figure 5:
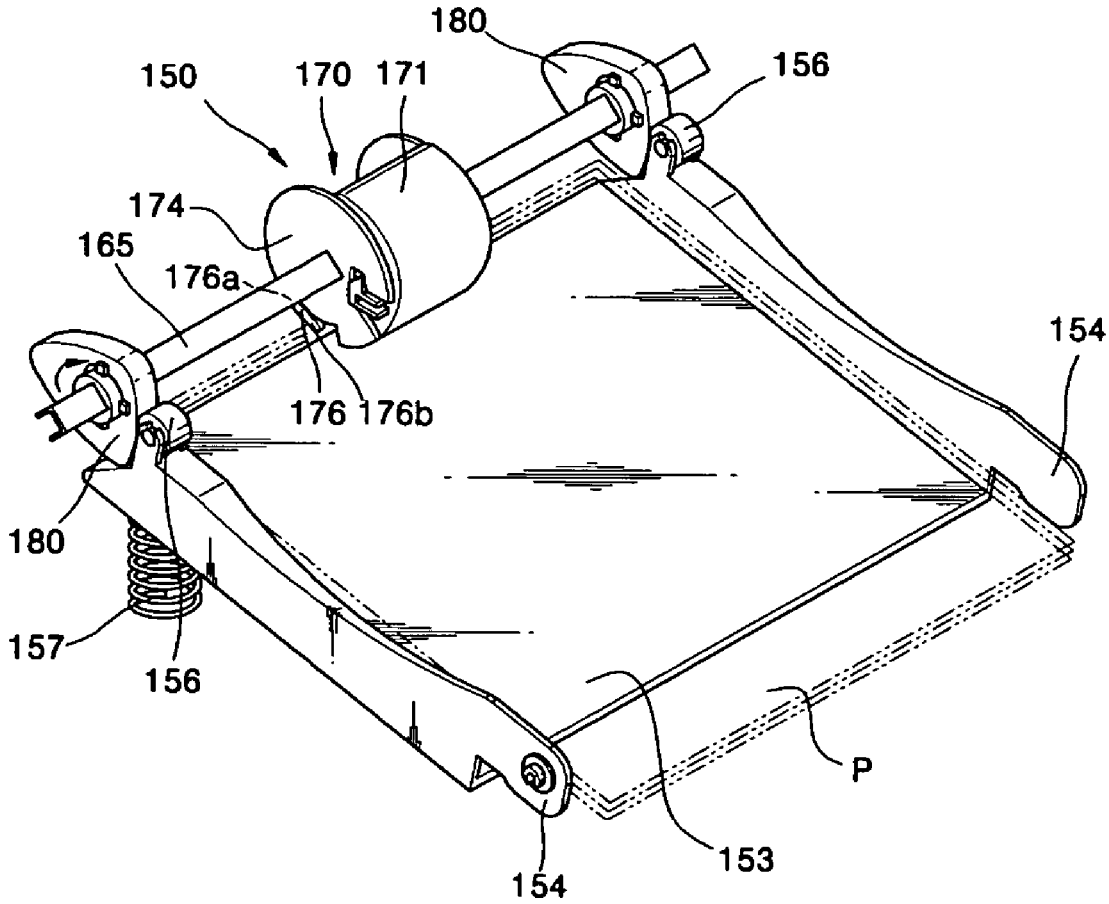
FIG. 5 is a perspective view illustrating the paper picking-up unit of the image forming apparatus of FIG. 3 at an instant the paper is picked up.

FIGS. 4 and 5 are perspective views illustrating the paper picking-up unit 150 of the image forming apparatus of FIG. 3. FIG. 4 illustrates the paper picking-up unit 150 in a state just before the paper P is picked up, and FIG. 5 illustrates the paper picking-up unit 150 at an instant the paper P is picked up. Referring to FIGS. 4 and 5, the paper picking-up unit 150 includes a knock-up plate 153 to stack the paper P thereon, which is coupled with a paper feeding cassette (see 151 of FIG. 3) by a hinge 154, a shaft 165 disposed at a front end of the knock-up plate 153 when the paper feeding cassette 151 is mounted on the image forming apparatus 100 and rotatable by power of a driving motor (not shown) inside the image forming apparatus 100, and a pick-up roller 170 which is engaged with the shaft 165 to rotate with the shaft 165.

The paper picking-up unit 150 further includes an ascending and descending portion which raises and lowers the knock-up plate 153 by the rotation of the pick-up roller 170 such that a front end of the paper P stacked on the knock-up plate 153 selectively contacts the pick-up roller 170. The ascending and descending portion includes a spring 157, which elastically biases the knock-up plate 153 upwards, and a pair of cams 180, which are engaged with opposite sides of the shaft 165, the pick-up roller 170 being disposed between the pair of cams 180 such that the cams 180 rotate together with the pick-up roller 170. In a printing standby state in which a printing instruction is not input into the image forming apparatus 100, as illustrated in FIG. 4, the cams 180 press the front end of the knock-up plate 153 at opposite sides to separate the paper P stacked on the knock-up plate 153 and the pick-up roller 170 from each other such that the paper P and the pick-up roller 170 do not contact each other. If a printing instruction is input into the image forming apparatus 100, the cams 180 rotate together with the pick-up roller 170 by the rotation of the shaft 165 and do not press the front end of the knock-up plate 153 at the opposite sides, as illustrated in FIG. 5. Thus, the front end of the knock-up plate 153 rises by the elasticity of the spring 157 and contacts the pick-up roller 170. A pair of idle rollers 156 are disposed at the opposite sides of the front end of the knock-up plate 153 so as to prevent abrasion and damage to the knock-up plate 153 from contacting the cams 180.

Whenever the pick-up roller 170 is rotated once, a sheet of the paper P is supplied to the paper aligning unit (see 140 of FIG. 3). The pick-up roller 170 includes a roller body 171 engaged and rotatable with the shaft 165, and having a generally semicircular shape and a pair of roller housings 174 which support opposite sides of the roller body 171 such that the roller body 171 does not move in a lengthwise direction of the shaft 165. A frictional layer formed of rubber is provided at an outer circumference of the roller body 171. The paper P stacked on the knock-up plate 153 is picked up by the pick-up roller 170 by friction with the frictional layer. A frictional pad (see 160 of FIG. 3) is disposed directly upstream of the knock-up plate 153 along the transfer path. Thus, even if a plurality of sheets of paper P are picked up by the pick-up roller 170, only the sheet of paper P that has been stacked on top of the knock-up plate 153 can travel toward the paper aligning unit (see 140 of FIG. 3) and the remainder of the sheets of paper P are obstructed by the frictional pad 160.

Even though the paper P is stacked on the knock-up plate 153, the front end of the knock-up plate 153 can collide with the roller body 171 and the roller housings 174 of the pick-up roller 170 when the knock-up plate 153 rises. A shock-absorbing piece 176 is disposed at an outer circumference of each roller housing 174 as a damper to reduce noise caused by the collision of the roller housings 174 and the knock-up plate 153. The shock-absorbing piece 176 is disposed in a position at which each roller housing 174 collides with the knock-up plate 153, and each roller housing 174 can be formed with the shock-absorbing piece 176 as a single body by plastic resin molding. The shock-absorbing piece 176 extends in a circular shape along the outer circumference of the respective roller housing 174. As illustrated in FIGS. 4 and 5, a first end **176*a* of the shock-absorbing piece 176 is connected to a first outer circumferential portion of the respective roller housing 174, and a second end 176*b* of the shock-absorbing piece 176 is separated from a second outer circumferential portion of the respective roller housing 174**.

When the front end of the knock-up plate 153 rises by the rotation of the cams 180 engaged with the shaft 165, the paper P is raised by the knock-up plate 153 and collides with the shock-absorbing piece 176 of each roller housing 174. Due to this collision, the shock-absorbing piece 176 is slightly bent in a central direction of the respective roller housing 174 and absorbs shocks caused by the collision such that noise and the shocks caused by the. collision are reduced. Subsequently, the pick-up roller 170 picks up the paper P when the frictional layer of the roller body 171 contacts the paper P, and the shock-absorbing piece 176 is returned to its original state by an elasticity thereof. A frictional coefficient of the shock-absorbing piece 176 is designed to be less than a frictional coefficient of the frictional layer of the roller body 171 such that the paper P is not prevented from being picked up by the pick-up roller 170 by friction with the shock-absorbing piece 176 when the pick-up roller 170 is rotated.

Figure 6:
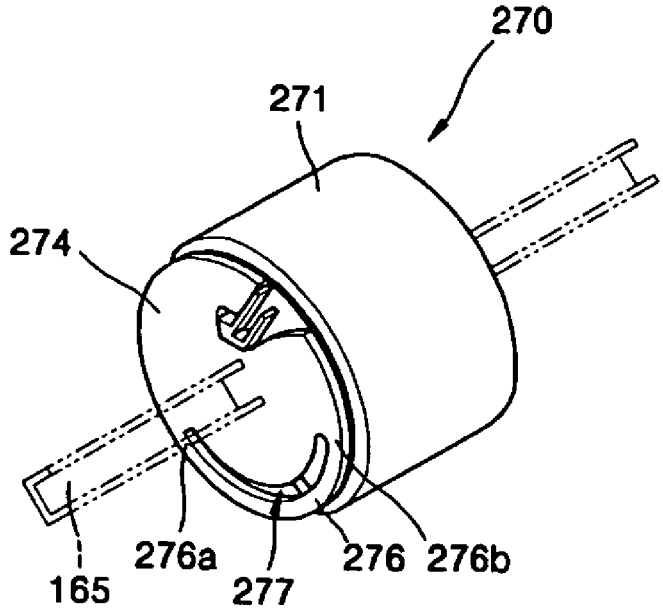
FIG. 6 is a perspective view illustrating a pick-up roller according to another embodiment of the present general inventive concept.

FIG. 6 is a perspective view illustrating a pick-up roller 270 according to another embodiment of the present general inventive concept.

Referring to FIG. 6, the pick-up roller 270 includes a roller body 271 engaged and rotatable with the shaft 165 and having a generally semicircular shape and a pair of roller housings 274 which support opposite sides of the roller body 271 such that the roller body 271 does not move in a lengthwise direction of the shaft 165. A frictional layer formed of rubber is provided at an outer circumference of the roller body 271.

A shock-absorbing piece 276 is disposed at an outer circumference of each roller housing 274 as a damper to reduce noise caused by a collision of the roller housings 274 and the knock-up plate (see 153 of FIGS. 3 and 4). The shock-absorbing piece 276 is disposed in a position at which each roller housing 274 collides with the knock-up plate 153. Each roller housing 274 can be formed with the shock-absorbing piece 276 as a single body by plastic resin molding. As illustrated in FIG. 6, a first end **276*a* and a second end 276*b* of the shock-absorbing piece 276** are respectively connected to first and second outer circumferential portions of the roller housings 274, and a slot 277 is formed in the respective roller housing 274 to define the shock-absorbing piece 276 and other portions thereof.

When the front end of the knock-up plate 153 rises, paper (P of FIGS. 3 and 4) raised by the knock-up plate 153 collides with the shock-absorbing piece 276 of each roller housing 274. Due to this collision, the shock-absorbing piece 276 is slightly bent in a central direction of the respective roller housing 274, the slot 277 is slightly distorted and the shock-absorbing piece 276 absorbs shocks caused by the collision such that noise and the shocks caused by collision are reduced. Subsequently, the pick-up roller 270 picks up the paper P when the frictional layer of the roller body 271 contacts the paper P, and the shock-absorbing piece 276 is returned to its original state by an elasticity thereof. A frictional coefficient of the shock-absorbing piece 276 is designed to be less than a frictional coefficient of the frictional layer of the roller body 271 such that the paper P is not prevented from being picked up by the pick-up roller 270 by friction with the shock-absorbing piece 276 when the pick-up roller 270 is rotated.

Figure 7:
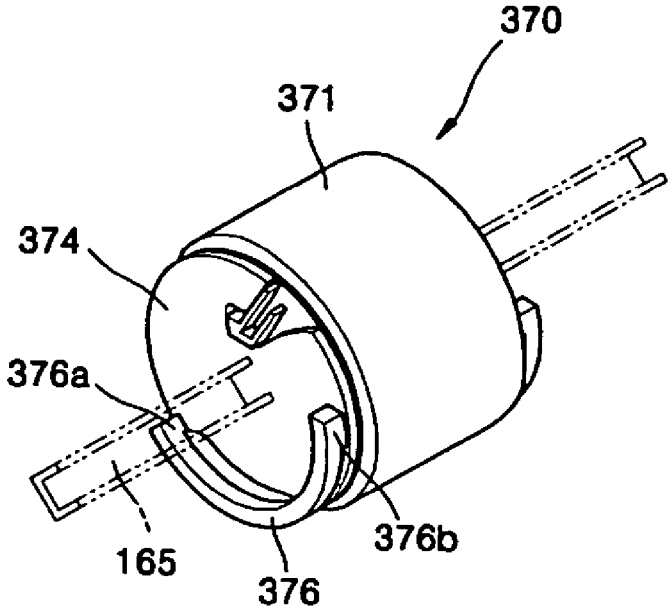
FIG. 7 is a perspective view illustrating a pick-up roller according to still another embodiment of the present general inventive concept.

FIG. 7 is a perspective view illustrating a pick-up roller 370 according to still another embodiment of the present general inventive concept. Referring to FIG. 7, the pick-up roller 370 includes a roller body 371 having a generally semicircular shape and a pair of roller housings 374 which support opposite sides of the roller body 371 to prevent the roller body 371 from moving in a lengthwise direction of the shaft 165. A frictional layer is provided at an outer circumference of the roller body 371.

A shock-absorbing piece 376 is disposed at an outer circumference of each roller housing 374 as a damper to reduce noise caused by a collision of the roller housings 374 and the knock-up plate (see 153 of FIGS. 3 and 4). The shock-absorbing piece 376 is disposed in a position at which each roller housing 374 collides with the knock-up plate 153. As illustrated in FIG. 7, the shock-absorbing piece 376 can be separately formed from each roller housing 374, and a first end 376*a* and a second end 376*b* of the shock-absorbing piece 376 are respectively connected to first and second outer circumferential portions of the roller housings 374 by a method, such as bonding, etc. Thus, the shock-absorbing piece 376 may be formed of a material having a greater shock-absorbing effect than a material of the roller housings 374.

When the front end of the knock-up plate 153 rises, the paper (P of FIGS. 3 and 4) raised by the knock-up plate 153 collides with the shock-absorbing piece 376. Due to this collision, the shock-absorbing piece 376 is slightly bent in a central direction of the respective roller housing 374 and absorbs shocks caused by the collision such that noise and the shocks caused by the collision are reduced. Subsequently, the pick-up roller 370 picks up the paper P when the frictional layer of the roller body 371 contacts the paper P, and the shock-absorbing piece 376 is returned to its original state by an elasticity thereof. A frictional coefficient of the shock-absorbing piece 376 is designed to be less than a frictional coefficient of the frictional layer of the roller body 371 such that the paper P is not prevented from being picked up by the pick-up roller 370 by friction with the shock-absorbing piece 376 when the pick-up roller 370 is rotated.

As described above, in a paper picking-up unit and an image forming apparatus having the same, according to the present general inventive concept, noise and shocks caused by a collision of a knock-up plate and a pick-up roller when the knock-up plate rises can be reduced. Thus, a user is not disturbed by collision noise, and jam or skew of paper that may occur when the paper is deviated from its registered position can be prevented.

Although a few embodiments of the present general inventive concept have been shown and described, it will be appreciated by those skilled in the art that changes may be made in these embodiments without departing from the principles and spirit of the general inventive concept, the scope of which is defined in the appended claims and their equivalents.

What is claimed is:

1. A paper picking-up unit comprising:
- a knock-up plate to stack paper thereon;
- a shaft disposed at a front end of the knock-up plate to rotate;
- a pick-up roller engaged with the shaft to rotate and pick-up the paper stacked on the knock-up plate; and
- a knock-up plate ascending and descending portion to raise and lower the knock-up plate according to the rotation of the pick-up roller, wherein the pick-up roller comprises:
- a roller body engaged and rotatable with the shaft, and having a frictional layer to pick-up the paper by causing friction with the paper,
- a pair of roller housings to support opposite sides of the roller body such that the roller body does not move in a lengthwise direction of the shaft, and
- a damper disposed on an outer circumference of each roller housing to contact the knock-up plate as the roller housings contact the knock-up plate to reduce noise caused by a collision of the roller housings and the knock-up plate.

2. The paper picking-up unit of claim 1, wherein the damper comprises a shock-absorbing piece extending from a first portion of the outer circumference to a second portion of the outer circumference of the respective roller housing.

3. The paper picking-up unit of claim 2, wherein a first end of the shock-absorbing piece is formed with the first portion of the outer circumference of the respective roller housing as a single body, and a second end thereof is separated from the second portion of the outer circumference of the respective roller housing.

4. The paper picking-up unit of claim 2, wherein a first end and a second end of the shock-absorbing piece are respectively formed with the first portion of the outer circumference and the second portion of the outer circumference of the respective roller housing as a single body.

5. The paper picking-up unit of claim 2, wherein the shock-absorbing piece is separately formed from the respective roller housing, and a first end and a second end of the shock-absorbing piece are respectively combined with the first portion of the outer circumference and the second portion of the outer circumference of the respective roller housing.

6. The paper picking-up unit of claim 1, wherein a frictional coefficient of the damper is less than a frictional coefficient of the frictional layer of the roller body.

7. An image forming apparatus comprising a printing unit to print an image on paper and a paper picking-up unit to pick-up the paper to be transferred into the printing unit, wherein the paper picking-up unit comprises:
- a knock-up plate to stack paper thereon;
- a shaft disposed at a front end of the knock-up plate to rotate;
- a pick-up roller engaged with the shaft to rotate and pick-up the paper stacked on the knock-up plate; and
- a knock-up plate ascending and descending portion to raise and lower the knock-up plate according to the rotation of the pick-up roller, wherein the pick-up roller comprises:

a roller body engaged and rotatable with the shaft and having a frictional layer to pick-up the paper by causing friction with the paper, a pair of roller housings to support opposite sides of the roller body such that the roller body does not move in a lengthwise direction of the shaft, and a damper disposed on an outer circumference of each roller housing to contact the knock-up plate as the roller housings contact the knock-up plate to reduce noise caused by a collision of the roller housings and the knock-up plate.

8. The apparatus of claim 7, wherein the damper is a shock-absorbing piece extending from a first portion of the outer circumference to a second portion of the outer circumference of the respective roller housing.

9. The apparatus of claim 8, wherein a first end of the shock-absorbing piece is formed with the first portion of the outer circumference of the respective roller housing as a single body, and a second end thereof is separated from the second portion of the outer circumference of the respective roller housing.

10. The apparatus of claim 8, wherein a first end and a second end of the shock-absorbing piece are respectively formed with the first portion of the outer circumference and the second portion of the outer circumference of the respective roller housing as a single body.

11. The apparatus of claim 8, wherein the shock-absorbing piece is separately formed from the respective roller housing, and a first end and a second end of the shock-absorbing piece are respectively combined with the first portion of the outer circumference and the second portion of the outer circumference of the respective roller housing.

12. The apparatus of claim 7, wherein a frictional coefficient of the damper is less than a frictional coefficient of the frictional layer of the roller body.

* * * * *